US009962765B2

(12) United States Patent
Hwang et al.

(10) Patent No.: US 9,962,765 B2
(45) Date of Patent: May 8, 2018

(54) METHOD OF PRODUCING WORKPIECE AND WORKPIECE THEREOF

(71) Applicant: Taiwan Powder Technologies Co., Ltd, Taoyuan County (TW)

(72) Inventors: Kuen-Shyang Hwang, Taipei (TW); Chi Kin Cheong, Macau (CN)

(73) Assignee: Taiwan Powder Technologies Co., Ltd., Taoyuan County (TW)

( * ) Notice: Subject to any disclaimer, the term of this patent is extended or adjusted under 35 U.S.C. 154(b) by 1050 days.

(21) Appl. No.: 13/661,191

(22) Filed: Oct. 26, 2012

(65) Prior Publication Data

US 2014/0037489 A1 Feb. 6, 2014

(30) Foreign Application Priority Data

Jul. 31, 2012 (TW) ..... 101127586 A

(51) Int. Cl.
*B22F 1/00* (2006.01)
*B22F 3/12* (2006.01)
(Continued)

(52) U.S. Cl.
CPC ..... *B22F 1/00* (2013.01); *B22F 1/0096* (2013.01); *B22F 3/10* (2013.01); *B22F 3/16* (2013.01);
(Continued)

(58) Field of Classification Search
CPC ..... B22F 5/007; B22F 3/16; B22F 1/0096; C22C 33/0257
See application file for complete search history.

(56) References Cited

U.S. PATENT DOCUMENTS 2,772,956 A * 12/1956 Phelps et al. ..... 75/362
6,332,904 B1 * 12/2001 Fujiki ..... C22C 33/0207 419/11
(Continued)

FOREIGN PATENT DOCUMENTS

CN 1820877 A 8/2006
CN 101797641 A 8/2010
JP 09104903 A * 4/1997

OTHER PUBLICATIONS

ASM International Handbook Committee. (1998). ASM Handbook, vol. 07—Powder Metal Technologies and Applications—14.1 Dry Mixing of Metal Powders. ASM International.*
(Continued)

*Primary Examiner* — Colleen P Dunn
*Assistant Examiner* — Jeremy C Jones
(74) *Attorney, Agent, or Firm* — Alan D. Kamrath; Kamrath IP Lawfirm, P.A.

(57) ABSTRACT

A method of producing a workpiece includes: providing a first powder, with a hardness of the first powder being less than 250 HV, and with a mean particle size of the first powder being less than 20 μm; mixing the first powder and a second powder to form a mixed powder, with the mixed powder including carbon, chromium, iron, and elements selected from the group consisting of molybdenum, nickel, copper, niobium, vanadium, tungsten, silicon, cobalt, and manganese; adding a binder and water to the mixed powder; applying a spray drying process to granulate the mixed powder to form a spray-dried powder; applying a dry pressing process to the spray-dried powder to form a green part; applying a debinding process to the green part to form a debound body; and sintering the debound body into a workpiece having a hardness of higher than 250 HV.

13 Claims, 3 Drawing Sheets

(51) Int. Cl.

| | |
|---|---|
| ***B32B 15/02*** | (2006.01) |
| ***B22F 3/10*** | (2006.01) |
| ***B22F 3/16*** | (2006.01) |
| ***C22C 38/18*** | (2006.01) |
| ***C22C 38/22*** | (2006.01) |
| ***C22C 38/24*** | (2006.01) |
| ***C22C 38/30*** | (2006.01) |
| ***C22C 38/42*** | (2006.01) |
| ***C22C 38/44*** | (2006.01) |
| ***C22C 38/48*** | (2006.01) |
| ***C22C 33/02*** | (2006.01) |
| ***C22C 27/06*** | (2006.01) |
| ***C22C 35/00*** | (2006.01) |
| ***C22C 38/02*** | (2006.01) |
| ***C22C 38/04*** | (2006.01) |

(52) U.S. Cl.

CPC ..... *C22C 27/06* (2013.01); *C22C 33/0257* (2013.01); *C22C 35/00* (2013.01); *C22C 38/02* (2013.01); *C22C 38/04* (2013.01); *C22C 38/18* (2013.01); *C22C 38/22* (2013.01); *C22C 38/24* (2013.01); *C22C 38/30* (2013.01); *C22C 38/42* (2013.01); *C22C 38/44* (2013.01); *C22C 38/48* (2013.01); *B22F 2998/10* (2013.01); *B22F 2999/00* (2013.01)

(56) References Cited

U.S. PATENT DOCUMENTS

2002/0004540 A1* 1/2002 Hendrickson ..... B22F 1/0059 523/205
2002/0159910 A1* 10/2002 Aslund ..... B22F 3/003 419/29
2003/0219617 A1* 11/2003 Ozaki ..... B22F 1/0059 428/570
2005/0252338 A1* 11/2005 Henmi ..... C22C 32/0089 75/246
2005/0274222 A1* 12/2005 Hwang et al. ..... 75/246
2006/0201280 A1* 9/2006 Hwang ..... B22F 3/1028 75/246
2010/0196188 A1 8/2010 Kalss et al.
2011/0209575 A1* 9/2011 Kadomura ..... B22F 1/0096 75/252

OTHER PUBLICATIONS

Schade, Christopher T., John W. Schaberl, and Alan Lawley. "Stainless Steel Aisi Grades For Pm Applications." International Journal of Powder Metallurgy 44.3 (2008): 57-67. Computers & Applied Sciences Complete. Web. Jun. 9, 2015.*

* cited by examiner

| Number | First powder hardness | First powder mean particle size | Spray-dried powder mean particle size | Green part density | Workpiece density | Workpiece relative density | Workpiece hardness |
|---|---|---|---|---|---|---|---|
| First Comparison | 310HV | 12μm | none | 6.1 g/cm$^3$ | 7.32 g/cm$^3$ | 94% | 285HV |
| First Embodiment | 160-180HV | 10.2μm | 55μm | 6.47 g/cm$^3$ | 7.55g/cm$^3$ | 97% | 305HV |
| Second Comparison | 320HV | 50μm | none | 6.2 g/cm$^3$ | 7.21 g/cm$^3$ | 92% | 265HV |
| Second Embodiment | 180HV | 10.3μm | 56μm | 6.30 g/cm$^3$ | 7.50 g/cm$^3$ | 96% | 295HV |
| Third Comparison | 380HV | 25μm | none | 5.9 g/cm$^3$ | 7.21 g/cm$^3$ | 93% | 407HV |
| Third Embodiment | 160HV | 12μm | 58μm | 6.42 g/cm$^3$ | 7.65 g/cm$^3$ | 99% | 468HV |
| Fourth Comparison | 410HV | 45μm | none | 5.6 g/cm$^3$ | 7.64 g/cm$^3$ | 96% | 549HV |
| Fourth Embodiment | <100HV | 5μm | 50μm | 6.50 g/cm$^3$ | 7.92 g/cm$^3$ | 99% | 590HV |
| Fifth Embodiment | <100HV | 5μm | 50μm | 6.50 g/cm$^3$ | 7.56 g/cm$^3$ | 97% | 310HV |
| Sixth Embodiment | 180HV | 10.3μm | 54μm | 6.30 g/cm$^3$ | 7.60 g/cm$^3$ | 99% | 310HV |
| Seventh Embodiment | <100HV | 5μm | 50μm | 6.6 g/cm$^3$ | 8.15 g/cm$^3$ | 99% | 485HV |
| Eighth Embodiment | 160-180HV | 10.2μm | 53μm | 6.55 g/cm$^3$ | 7.65 g/cm$^3$ | 98% | 320HV |

FIG. 3

METHOD OF PRODUCING WORKPIECE AND WORKPIECE THEREOF

BACKGROUND OF THE INVENTION

1. Field of the Invention

The present invention relates to a method of producing a workpiece. More particularly, the present invention relates to a method which applies a dry pressing process to produce a workpiece with high hardness.

The present invention relates to a method of producing a workpiece; more particularly, the present invention relates to a method which applies a dry pressing process to produce a workpiece with high hardness.

2. Description of the Related Art

The dry pressing process is a common process in traditional powder metallurgy. In the dry pressing process, a powder is filled into the mold, and then pressure is applied to the powder to compress the loose powder and form a green part with a certain density. Finally, the green part is sintered to form a workpiece. The process can be used to automatically produce a net-shaped workpiece at low cost. Therefore, in machinery manufacturing, the dry pressing process is a necessary process.

Generally speaking, in the dry pressing process, for a workpiece to have desirable mechanical or physical properties, the density of the workpiece should be increased, which means the density of the green part should be increased to reduce the sintering temperature and time and thereby to reduce costs. Furthermore, after sintering, the shrinkage of the workpiece of a green part of high density is less than the shrinkage of a workpiece of a green part of low density. Therefore, the dimensional stability of a workpiece formed from a high-density green part is superior to the dimensional stability of a workpiece formed from a low-density green part. The major factors affecting the green part density are:

(1) Pressure of forming: In the dry pressing process, using higher pressure for forming produces a green part with a higher density. However, the metal powder is subject to work-hardening. Therefore, when the pressure increases, the hardness of the powder will also increase, such that the increasing efficiency of the green part density will gradually decrease with the increasing forming pressure. Furthermore, when the pressure of forming increases, the friction between the powder and the mold will increase, too. Therefore, the surface of the mold may be damaged.

(2) Powder feature: The hardness of the powder affects the density of the green part. A powder with a high hardness is not easily deformed, and thus the powder cannot easily be filled into the pores between the powders. Therefore, the green part density cannot be increased easily, and the workpiece cannot have a high density. The shape, the size, and the internal structure of the powder affect the forming of the powder. For example, the compressibility of a powder with an irregular shape and internal pores is poor, and the compressibility of a powder with a regular shape and no internal pores is good. In contrast, the friction of a powder with spherical shape is small, and the apparent density is high. Thus, the density of the green part will be high.

In addition to the powder shape and internal structure, the size of the powder affects the density of the green part. The contact area between fine powders is greater than the contact area between coarse powders. Thus, in the fine powder, the friction is great, and the apparent density is low. Therefore, the powder must be pressed with a greater forming pressure to obtain the required green part density. Furthermore, a fine powder does not flow easily, so the fine powder cannot be filled into the mold cavity via an automatic process. However, the sintering driving force of the fine powder is great, and the density of the workpiece of the fine powder is high.

Therefore, to produce a workpiece with high density, a fine powder and a high green density must be applied to increase the density of the sintered part. However, the fine powder must be pressed by a great pressure to increase the density of the green part, and the great pressure may cause the mold to be damaged. Furthermore, if the hardness of the powder applied in the dry pressing process is high, then the difficulty of the process will increase. Therefore, the dry pressing process manufacturer usually does not produce workpieces with high sintered density and high hardness. For example, if an alloy powder with a hardness of 320 HV(32 HRC) is applied in the dry pressing process, then the powder will not easily be deformed during the pressing process, the compressibility will be poor, and the density of the green part will be low. If a common size powder (one with a mean particle size higher than 44 μm) and a common pressure (400-800 MPa) are applied in the dry pressing process, the green density of the workpiece usually will be less than 6.3 g/cm$^3$, or less than 80% of the theoretical density. Since the density of the green part is low, and since the mean particle size is large, the density of the workpiece and the mechanical properties will be low.

Therefore, there is a need to provide a new method to produce a workpiece by powder metallurgy. In the new method, via the dry pressing process, a workpiece with high hardness and great density can be produced, and the damage to the mold caused by the pressure of the pressing process can be reduced.

SUMMARY OF THE INVENTION

It is an object of the present invention to provide a method of producing a powder metallurgy workpiece with high density and high hardness.

To achieve the abovementioned object, the method of producing a workpiece of the present invention includes the steps of: providing a first powder, with a hardness of the first powder being less than 250 HV, and with a mean particle size of the first powder being less than 20 λm, mixing the first powder and a second powder to form a mixed powder, with the mixed powder including carbon, chromium, iron, and elements selected from the group consisting of molybdenum, nickel, copper, niobium, vanadium, tungsten, silicon, cobalt and manganese; adding a binder and water to the mixed powder; applying a spray drying process to granulate the mixed powder to form a spray-dried powder; applying a dry pressing process to the spray-dried powder to form a green part; applying a debinding process to the green part to form a debound body; and sintering the debound body into a workpiece having a hardness of higher than 250 HV.

BRIEF DESCRIPTION OF THE DRAWINGS

FIG. 3 illustrates an experimental data table of producing a workpiece according to the present invention.

DETAILED DESCRIPTION OF THE PREFERRED EMBODIMENTS

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
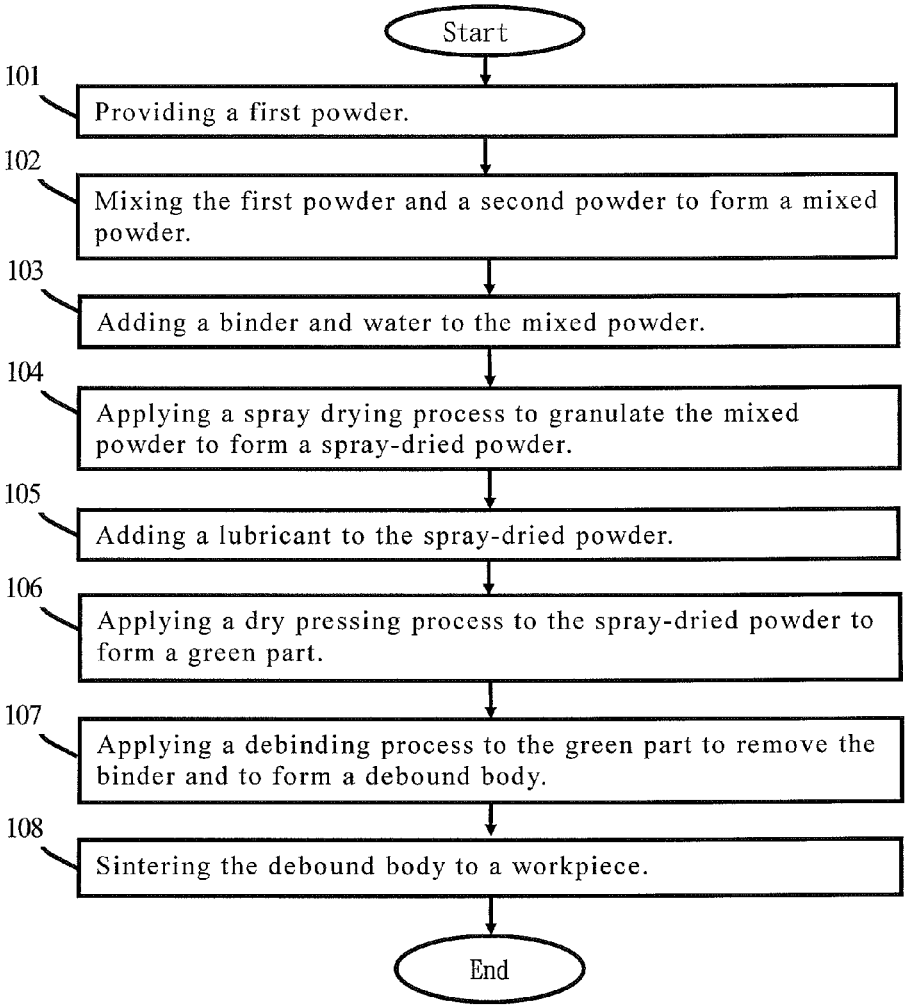
FIG. 1 illustrates a flowchart of the method of producing a workpiece according to the present invention.
Figure 2:
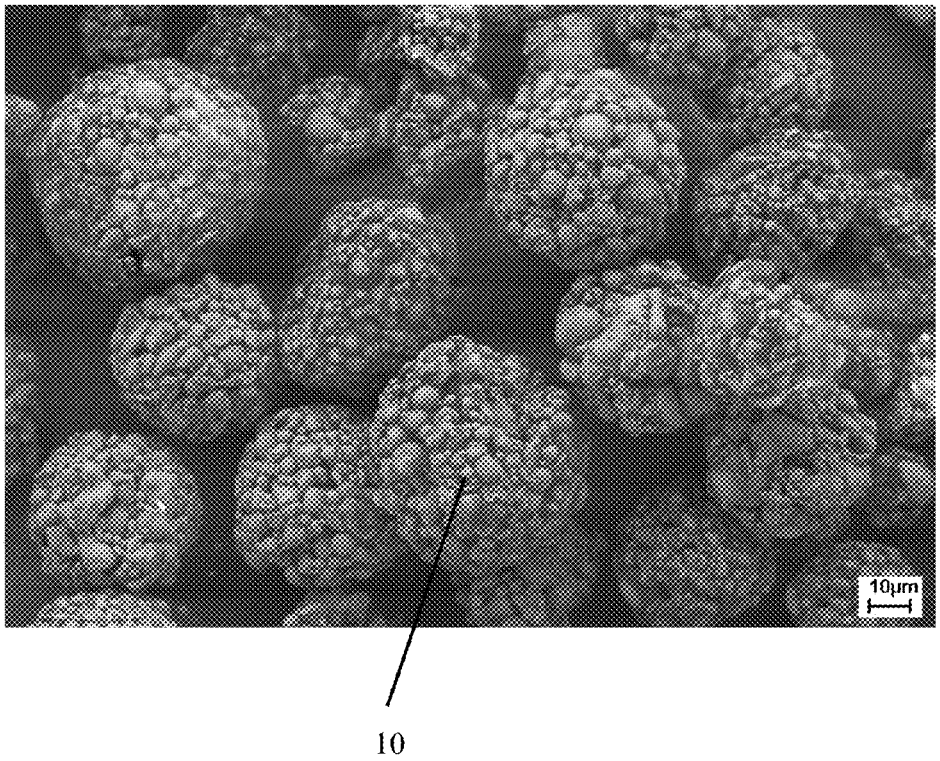
FIG. 2 illustrates a scanning electron micrograph of the spray-dried powder of the method of producing a workpiece according to one embodiment of the present invention.

Please refer to FIG. 1 and FIG. 2 regarding the method of producing a workpiece according to the present invention. FIG. 1 illustrates a flowchart of the method of producing a workpiece according to the present invention; and FIG. 2 illustrates a scanning electron micrograph of the spray-dried powder of the method of producing a workpiece according to one embodiment of the present invention.

In the embodiment of the present invention, the method of producing a workpiece of the present invention is applied for producing a high-density, high-hardness, and chromium-containing workpiece of stainless steel, high-speed steel, or tool steel. However, the workpiece of the present invention is not limited to that design.

As shown in FIG. 1, the method of producing the workpiece of the present invention comprises the steps of:

Step 101: providing a first powder.

The first powder is a low hardness powder to increase the compressibility. The first powder also has a small mean particle size to increase the sintered density of the workpiece. In the embodiment of the present invention, the hardness of the first powder is substantially less than 250 HV, and the mean particle size of the first powder is substantially less than 20 μm. The first powder can be an iron powder, a chromium-containing stainless steel powder of ferrite type, a chromium-containing stainless steel powder of austenite type, or other chromium-containing pre-alloyed powder. However, the first powder of the present invention is not limited to that design.

Step 102: mixing the first powder and a second powder to form a mixed powder.

In the embodiment of the present invention, the second powder is mixed from appropriate amounts of elemental powder, pre-alloyed powder, or master alloy powder according to the desired alloying elements. However, the present invention is not limited to that design. The second powder has a small mean particle size, with the mean particle size being substantially less than 20 μm to increase the sintered density of the workpiece. However, the present invention is not limited to that design. In the mixed powder mixed from the first powder and the second powder, the weight percent of the first powder is the larger proportion, with the weight percent of carbon in the mixed powder being substantially less than 0.07 wt % or higher than 0.81 wt %, the weight percent of chromium being substantially between 3.5 to 18 wt %, the weight percent of molybdenum being substantially less than 6 wt %, the weight percent of nickel being substantially less than 5 wt %, the weight percent of copper being substantially less than 5 wt %, the weight percent of niobium being substantially less than 4 wt %, the weight percent of vanadium being substantially less than 5.5 wt %, the weight percent of cobalt being substantially less than 5.5 wt %, the weight percent of tungsten being substantially less than 13 wt %, the weight percent of silicon being substantially between 0.1 to 1 wt %, and the weight percent of manganese being substantially between 0.1 to 1 wt %. However, the present invention is not limited to that design.

Step 103: adding binder and water to the mixed powder.

In the embodiment of the present invention, appropriate amounts of binder and water are added to the mixed powder, and the binder, the water, and the mixed powder are stirred into a slurry. The binder can be polyvinyl alcohol, arabic gum, or methyl cellulose, but the type of the binder is not limited to the design.

Step 104: applying a spray drying process to granulate the mixed powder to form a spray-dried powder.

After the binder and the water are added to the mixed powder and mixed into a slurry, a spray drying process is applied to the mixed powder to transform the slurry into the spherical spray-dried powder 10 (as shown in FIG. 2). After the spray drying process, the mixed powder has a large mean particle size and spherical shape, and, therefore, the flowability and apparent density are improved, facilitating the filling of the powder into the mold cavity.

Step 105: adding a lubricant to the spray-dried powder.

A lubricant is added to the spray-dried powder 10 to improve the flowability of the spray-dried powder 10 and to decrease the friction between the powder and the mold, allowing the spray-dried powder 10 to be molded smoothly. In the present invention, the lubricant can be ethylene bis-stearamide or zinc stearate, but the lubricant of the present invention is not limited to the abovementioned types.

Step 106: applying a dry pressing process to the spray-dried powder to form a green part.

The spray-dried powder 10 is filled into the mold, and then a desired pressure is applied to the spray-dried powder 10, allowing the loose spray-dried powder 10 to form a green part with a certain density. In the present invention, the temperature of the dry pressing process is substantially less than 160° C., and the density of the green part is substantially higher than 6.3 g/cm$^3$. However, the present invention is not limited to that design.

Step 107: applying a debinding process to the green part to remove the binder and to form a debound body.

A debinding process is applied to the green part to remove the lubricant and the binder and to form a debound body, such that the debound body without the lubricant and the binder is prepared for the following sintering process.

Step 108: sintering the debound body into a workpiece.

A sintering process is applied to the debound body to form the debound body into a workpiece. The debound body is sintered in a vacuum or hydrogen-containing environment, but the environment of sintering of the present invention is not limited to that design. The hardness of the workpiece is substantially higher than 250 HV, and the density is substantially higher than 7.4 g/cm$^3$. However, the hardness and the density of the workpiece of the present invention are not limited to that design.

Via the abovementioned steps of the present invention, the spray-dried powder 10 can have great flowability, low hardness, and great compressibility, allowing the density of the green part to be increased, and damage to the mold caused by pressure during the dry pressing process can be reduced. Therefore, after the debound body is sintered, and since the mean particle size of the original powder is small, the debound body will shrink and have a high density, such that the density of the workpiece will be relatively high. Furthermore, after the sintering process, the alloying elements will be dissolved into the iron base and be distributed evenly, such that the hardness of the workpiece will be relatively high.

First Comparison

In the first comparison, a pre-alloyed powder is prepared. In the pre-alloyed powder, the weight percent of carbon is 0.029 wt %, the weight percent of silicon is 0.78 wt %, the weight percent of manganese is 0.31 wt %, the weight percent of chromium is 15.6 wt %, the weight percent of molybdenum is 0.69 wt %, the weight percent of nickel is 4.20 wt %, the weight percent of copper is 3.50 wt %, the weight percent of niobium is 0.15 wt %, and the rest is iron.

The hardness of the pre-alloyed powder is 310 HV. The mean particle size of the pre-alloyed powder is 12 μm. The pre-alloyed powder does not have good flowability.

To the pre-alloyed powder is added 0.5 wt % Acrawax (ethylene bis-stearamide) as a lubricant. After the lubricant is added, a pressure of 800 MPa is applied to the pre-alloyed powder according to the traditional dry pressing method at room temperature to form a green part. The density of the green part is 6.1 g/cm$^3$. After pressing, the green part is put into the tube furnace. In an atmosphere of cracked ammonia ($3H_2+N_2$) and at a temperature between 300 to 600° C., the lubricant is removed from the green part via the debinding process, and then the green part is sintered for 2 hours at a stable temperature of 1350° C. to form a workpiece. The density of the workpiece is 7.32 g/cm$^3$, the relative density is 94%, and the hardness is 285 HV.

First Embodiment

In the first embodiment, the first powder is made of Fe-17Cr (430L stainless steel), which comprises 17 wt % chromium and small amounts of silicon, manganese, and carbon, with the carbon being 0.02 wt % of the first powder. The Fe-17Cr is a stainless steel powder of ferrite type and has a hardness between 160 HV to 180 HV and mean particle size of 10.2 μm. The composition of the second powder comprises iron, chromium, nickel, copper, molybdenum, and small amounts of silicon, manganese, carbon, and niobium. The second powder is made of Fe-17Cr-12Ni-2Mo (316L stainless steel) powder, copper elemental powder, and niobium elemental powder. The 316L stainless steel powder comprises 17 wt % chromium, 12 wt % nickel, 2 wt % molybdenum, and small amounts of silicon, manganese, and carbon. The mean particle sizes of the 316L stainless steel powder, the copper elemental powder, and the niobium elemental powder are all less than 15 μm. The composition of the mixed powder mixed from the first powder and the second powder is substantially similar to that of the pre-alloyed powder of the first comparison. In the mixed powder, the weight percent of carbon is 0.028 wt %, the weight percent of silicon is 0.75 wt %, the weight percent of manganese is 0.28 wt %, the weight percent of chromium is 15.6 wt %, the weight percent of molybdenum is 0.68 wt %, the weight percent of nickel is 4.10 wt %, the weight percent of copper is 3.50 wt %, the weight percent of niobium is 0.15 wt %, and the rest is iron.

Appropriate amounts of water and binder of polyvinyl alcohol and polyethylene glycol are added into the mixed powder and stirred into a slurry, and the spray drying process is applied to the slurry to form a spray-dried powder 10. The mean particle size of the spray-dried powder 10 is 55 μm, and the binder is about 1.2 wt %. To the spray-dried powder 10 is added 0.1 wt % Acrawax (ethylene bis-stearamide) as a lubricant. After the lubricant is added, a pressure of 800 MPa is applied to the spray-dried powder 10 according to the traditional dry pressing method at room temperature to form a green part. The density of the green part is 6.47 g/cm$^3$. After pressing, the green part is put into a tube furnace. In an atmosphere of cracked ammonia and at a temperature between 300 to 600° C., the lubricant and binder are removed from the green part via the debinding process, and then the green part is sintered for 2 hours at a stable temperature of 1350° C. to form a stainless steel workpiece. The density of the workpiece is 7.55 g/cm$^3$, the relative density is 97%, and the hardness is 305 HV. The density, relative density, and the hardness of the workpiece of the first embodiment are higher than those of the workpiece of the first comparsion.

Second Comparison

In the second comparison, a pre-alloyed powder of 17-4PH stainless steel is prepared. In the pre-alloyed powder, the weight percent of carbon is 0.030 wt %, the weight percent of silicon is 0.78 wt %, the weight percent of manganese is 0.10 wt %, the weight percent of chromium is 16.0 wt %, the weight percent of nickel is 4.00 wt %, the weight percent of copper is 4.00 wt %, the weight percent of niobium is 0.30 wt %, and the rest is iron. The hardness of the pre-alloyed powder is 320 HV. The mean particle size of the pre-alloyed powder is 50 μm.

A pressure of 800 MPa is applied to the pre-alloyed powder according to the traditional dry pressing method at room temperature to form a green part. The density of the green part is 6.2 g/cm$^3$. After pressing, the green part is put into a tube furnace and sintered for 2 hours at a stable temperature of 1320° C. and in an atmosphere of hydrogen to form a workpiece. The density of the workpiece is 7.21 g/cm$^3$, the relative density is 92%, and the hardness is 265 HV.

Second Embodiment

In the second embodiment, the first powder is made of pre-alloyed powder of Fe-17Cr (430L stainless steel), which comprises 17 wt % chromium and small amounts of silicon, manganese, and carbon, with the carbon being 0.025 wt % in the first powder. The first powder is a stainless steel powder of ferrite type and has hardness of 180 HV and mean particle size of 10.3 μm. The second powder is made of nickel, copper, niobium, and iron. The nickel and the copper are added in the form of elemental powders, and the iron and the niobium are added in the form of pre-alloyed powder of Fe-60Nb. The composition of the mixed powder mixed from the first powder and the second powder is substantially similar to the pre-alloyed powder of the second comparison. In the mixed powder, the weight percent of carbon is 0.028 wt %, the weight percent of silicon is 0.70 wt %, the weight percent of manganese is 0.10 wt %, the weight percent of chromium is 16.0 wt %, the weight percent of nickel is 4.00 wt %, the weight percent of copper is 4.00 wt %, the weight percent of niobium is 0.30 wt %, and the rest is iron.

Appropriate amounts of water and binder of polyvinyl alcohol are added into the mixed powder to produce a slurry. Then, the spray drying process is applied to the slurry to form a spray-dried powder 10. The mean particle size of the spray-dried powder 10 is 56 μm. A pressure of 800 MPa is applied to the spray-dried powder 10 according to the traditional dry pressing method at room temperature to form a green part. The density of the green part is 6.30 g/cm$^3$. After pressing, the green part is put into a tube furnace. In an atmosphere of hydrogen, the binder is removed from the green part via the debinding process, and then the green part is sintered for 2 hours at a stable temperature of 1320° C. to form a 17-4PH stainless steel workpiece. The density of the workpiece is 7.50 g/cm$^3$, the relative density is 96%, and the hardness is 295 HV. The density, the relative density, and the hardness of the workpiece of the second embodiment are higher than those of the workpiece of the second comparison.

Third Comparison

In the third comparison, the pre-alloyed powder is made of SKD11 tool steel (according to Japanese Industrial Standards, the composition of SKD11 tool steel comprises the following: carbon, which is between 1.4-1.6%; silicon, which is less than 0.4%; manganese, which is less than 0.6%; nickel, which is less than 0.5%; chromium, which is between 11-13%; molybdenum, which is between 0.8-1.2%; vanadium, which is between 0.2-0.5%; and iron, which is the remainder). In the pre-alloyed powder, the weight percent of carbon is 1.52 wt %, the weight percent of silicon is 0.30 wt %, the weight percent of manganese is 0.43 wt %, the weight percent of chromium is 11.7 wt %, the weight percent of molybdenum is 1.01 wt %, the weight percent of vanadium is 0.38 wt %, and the rest is iron. The hardness of the pre-alloyed powder is 380 HV. The mean particle size of the pre-alloyed powder is 25 μm.

A lubricant of 0.1 wt % zinc stearate is added to the pre-alloyed powder. A pressure of 800 MPa is applied to the pre-alloyed powder according to the traditional dry pressing method at room temperature to form a green part. The density of the green part is 5.9 g/cm$^3$. After pressing, the green part is put into a vacuum furnace. In the vacuum furnace, the lubricant is removed from the green part via the debinding process, and then the green part is sintered for 1.5 hours at a stable temperature of 1250° C. to form a workpiece. The density of the workpiece is 7.21 g/cm$^3$, the relative density is 93%, and the hardness is 407 HV.

Third Embodiment

In the third embodiment, the first powder is made of pre-alloyed powder of Fe-12Cr, which comprises 12 wt % chromium and small amounts of silicon, manganese, and carbon, with the carbon being 0.02 wt %. The first powder is a 410L stainless steel powder and has hardness of 160 HV and mean particle size of 12.0 μm. The second powder comprises a pre-alloyed powder of Fe-45V, a small amount of graphite elemental powder, and a small amount of molybdenum elemental powder. The composition of the mixed powder mixed from the first powder and the second powder is substantially similar to that of the SKD11 tool steel powder of the third comparison. In the mixed powder, the weight percent of carbon is 1.52 wt %, the weight percent of silicon is 0.26 wt %, the weight percent of manganese is 0.40 wt %, the weight percent of chromium is 11.7 wt %, the weight percent of molybdenum is 1.01 wt %, the weight percent of vanadium is 0.38 wt %, and the rest is iron.

Appropriate amounts of water and binder of polyvinyl alcohol and polyethylene glycol are added into the mixed powder to produce a slurry. Then, the spray drying process is applied to the slurry to form a spray-dried powder 10. The mean particle size of the spray-dried powder 10 is 58 μm. To the spray-dried powder is added 0.1% Acrawax as a lubricant. A pressure of 800 MPa is applied to the spray-dried powder 10 according to the traditional dry pressing method at room temperature to form a green part. The density of the green part is 6.42 g/cm$^3$. After pressing, the green part is put into a vacuum furnace. In the vacuum furnace, the lubricant and the binder are removed via the debinding process, and then the green part is sintered for 1.5 hours at a stable temperature of 1250° C. to form an SKD11 tool steel workpiece. The density of the workpiece is 7.65 g/cm$^3$, the relative density is 99%, and the hardness is 468 HV. The density, the relative density, and the hardness of the workpiece of the third embodiment are higher than those of the workpiece of the third comparison.

Fourth Comparison

In the fourth comparison, an M2 high-speed steel (according to the American Iron and Steel Institute, the composition of M2 high-speed steel comprises the following: carbon, which is between 0.78-1.05%; silicon, which is between 0.20-0.45%, manganese, which is between 0.15-0.40%; chromium, which is between 3.75-4.50%; molybdenum, which is between 4.5-5.5%; vanadium, which is between 1.75-2.20%; tungsten, which is between 5.50-6.75%; and iron, which is the remainder) pre-alloyed powder is prepared. In the pre-alloyed powder, the weight percent of carbon is 0.95 wt %, the weight percent of silicon is 0.25 wt %, the weight percent of manganese is 0.18 wt %, the weight percent of chromium is 4.3 wt %, the weight percent of molybdenum is 5.01 wt %, the weight percent of vanadium is 1.82 wt %, the weight percent of tungsten is 6.21 wt %, and the rest is iron. The hardness of the pre-alloyed powder is 410 HV. The mean particle size of the pre-alloyed powder is 45 μm.

A lubricant of 0.5 wt % Acrawax is added into the pre-alloyed powder. A pressure of 800 MPa is applied to the pre-alloyed powder according to the traditional dry pressing method at room temperature to form a green part. The density of the green part is 5.6 g/cm$^3$. After pressing, the green part is put into a vacuum furnace. In the vacuum furnace, the lubricant is removed from the green part via the debinding process, and then the green part is sintered for 1.5 hours at a stable temperature of 1250° C. to form a workpiece. The density of the workpiece is 7.64 g/cm$^3$, the relative density is 96%, the shrinkage of the workpiece is 9.8%, and the hardness is 549 HV.

Fourth Embodiment

In the fourth embodiment, the composition of the first powder comprises low hardness carbonyl iron powder, with the carbon content of the carbonyl iron powder being 0.04 wt %. The carbonyl iron powder has hardness less than 100 HV, and mean particle size of 5 μm. The composition of the second powder comprises a Fe-13Cr stainless steel powder with small amounts of silicon, manganese, and carbon; elemental powders of graphite, molybdenum, and tungsten; and the alloy powder of Fe-45V. The Fe-13Cr stainless steel powder is a 410L stainless steel powder and has hardness of about 160 HV and mean particle size of 12.0 μm. The composition of the mixed powder mixed from the first powder and the second powder is substantially similar to that of the M2 high-speed steel pre-alloyed powder of the fourth comparison. In the mixed powder, the weight percent of carbon is 0.95 wt %, the weight percent of silicon is 0.21 wt %, the weight percent of manganese is 0.16 wt %, the weight percent of chromium is 4.3 wt %, the weight percent of molybdenum is 5.01 wt %, the weight percent of vanadium is 1.82 wt %, the weight percent of tungsten is 6.21 wt %, and the rest is iron.

Appropriate amounts of water and binder of polyvinyl alcohol and polyethylene glycol are added into the mixed powder to produce a slurry. Then, the spray drying process is applied to the slurry to form a spray-dried powder 10. The mean particle size of the spray-dried powder 10 is 50 μm. A lubricant of Acrawax is added into the spray-dried powder 10. A pressure of 800 MPa is applied to the spray-dried powder 10 according to the traditional dry pressing method at room temperature to form a green part. The density of the green part is 6.5 g/cm$^3$. After pressing, the green part is put into a vacuum furnace. In the vacuum furnace, the lubricant and the binder are removed via the debinding process, and then the green part is sintered for 1.5 hours at a stable temperature of 1250° C. to form an M2 high-speed steel workpiece. The density of the workpiece is 7.92 g/cm$^3$, the relative density is 99%, the shrinkage of the workpiece is 6.8%, and the hardness is 590 HV. The density, the relative density, and the hardness of the workpiece of the fourth embodiment are higher than those of the workpiece of the fourth comparison. The density of the green part is high, so the shrinkage (6.8%) of the workpiece of the fourth embodiment is less than the shrinkage (9.8%) of the workpiece of the fourth comparison, and the dimensional stability of the fourth embodiment is superior to the dimensional stability of the fourth comparison.

Fifth Embodiment

In the fifth embodiment, the first powder comprises a low hardness carbonyl iron powder, with the carbon content of the carbonyl iron powder being 0.05 wt %. The carbonyl iron powder has hardness of less than 100 HV and mean particle size of 5 μm. The second powder is a master alloy powder of Fe-51.6Cr-13.4Ni-12.6Cu-1.4Mn-1.2Si-0.7Nb. The mean particle size of the second powder is 10 μm. The composition of the mixed powder mixed from the first powder and the second powder is substantially approximate to that of the 17-4PH stainless steel. In the mixed powder, the weight percent of carbon is 0.05 wt %, the weight percent of silicon is 0.40 wt %, the weight percent of manganese is 0.47 wt %, the weight percent of chromium is 17.2 wt %, the weight percent of nickel is 4.47 wt %, the weight percent of copper is 4.20 wt %, the weight percent of niobium is 0.23 wt %, and the rest is iron.

Appropriate amounts of water and binder of polyvinyl alcohol and polyethylene glycol are added into the mixed powder to produce a slurry. Then, the spray drying process is applied to the slurry to form a spray-dried powder 10. The mean particle size of the spray-dried powder 10 is 50 μm. A lubricant of Acrawax is added into the spray-dried powder 10. A pressure of 800 MPa is applied to the spray-dried powder 10 according to the traditional dry pressing method at room temperature to form a green part. The density of the green part is 6.5 g/cm$^3$. After pressing, the green part is put into a vacuum furnace. In the vacuum furnace, the lubricant and the binder are removed via the debinding process, and then the green part is sintered for 2 hours at a stable temperature of 1320° C. to form a 17-4PH stainless steel workpiece. The density of the workpiece is 7.56 g/cm$^3$, the relative density is 97%, and the hardness is 310 HV.

Sixth Embodiment

In the sixth embodiment, the first powder is a pre-alloyed powder of Fe-17Cr (430L stainless steel). The first powder comprises 17 wt % chromium and small amounts of silicon, manganese, and carbon, with the carbon content of the first powder being 0.03 wt %. The first powder is a stainless steel powder of ferrite type and has hardness of 180 HV and mean particle size of 10.3 μm. The composition of the second powder comprises graphite and elemental powder of molybdenum. The first powder and the second powder are mixed to form a mixed powder. In the mixed powder, the weight percent of carbon is 1.01 wt %, the weight percent of silicon is 0.84 wt %, the weight percent of manganese is 0.83 wt %; the weight percent of chromium is 16.9 wt %, the weight percent of molybdenum is 0.35 wt %, the weight percent of niobium is 3.2 wt %, and the rest is iron.

Appropriate amounts of water and binder of polyvinyl alcohol and polyethylene glycol are added into the mixed powder to produce a slurry. Then, the spray drying process is applied to the slurry to form a spray-dried powder 10. The mean particle size of the spray-dried powder 10 is 54 μm. A lubricant of stearic acid is added into the spray-dried powder 10. A pressure of 800 MPa is applied to the spray-dried powder 10 according to the traditional dry pressing method at room temperature to form a green part. The density of the green part is 6.30g/cm$^3$. After pressing, the green part is put into a vacuum furnace. In the vacuum furnace, the lubricant and the binder are removed via the debinding process, and then the green part is sintered for 1.5 hours at a stable temperature of 1280° C. to form a workpiece of 440C stainless steel of martensite type. The density of the workpiece is 7.60 g/cm$^3$, the relative density is 99%, and the hardness is 310 HV.

Seventh Embodiment

In the seventh embodiment, the first powder is a low hardness carbonyl iron powder, with the content of the carbon of the carbonyl iron powder being 0.02 wt %. The hardness of the first powder is less than 100 HV, and the mean particle size is 5 μm. The composition of the second powder comprises the stainless steel powder of Fe-13Cr with small amounts of silicon, manganese, and carbon, and elemental powders of graphite, tungsten, and molybdenum; and the alloy powder of Fe-45V. The stainless steel powder of Fe-13Cr is a 410L stainless steel powder and has hardness of 160 HV and mean particle size of 12.0 μm. The composition of the mixed powder mixed from the first powder and the second powder is substantially approximate to the composition of T15 high-speed steel (according to the American Iron and Steel Institute, the composition of T15 high-speed steel is the following: carbon, which is between 1.5-1.6%; silicon, which is between 0.15-0.40%; manganese, which is between 0.15-0.40%; chromium, which is between 3.75-5.00%; molybdenum, which is less 1.0%; cobalt, which is between 4.75-5.25%; vanadium, which is between 4.50-5.25%; tungsten, which is between 11.75-13.0%; and the rest is iron). In the mixed powder, the weight percent of carbon is 1.55 wt %, the weight percent of silicon is 0.30 wt %, the weight percent of manganese is 0.30 wt %, the weight percent of chromium is 3.8 wt %, the weight percent of molybdenum is 0.35 wt %, the weight percent of vanadium is 5.0 wt %, the weight percent of tungsten is 12.0 wt %, the weight percent of cobalt is 5.0 wt %, and the rest is iron.

Appropriate amounts of water and binder of polyvinyl alcohol and polyethylene glycol are added into the mixed powder to produce a slurry. Then, the spray drying process is applied to the mixed powder to form a spray-dried powder 10. The mean particle size of the spray-dried powder 10 is 50 μm. A lubricant of Acrawax is added into the spray-dried powder 10. A pressure of 800 MPa is applied to the spray-dried powder 10 according to the traditional dry pressing method at room temperature to form a green part. The density of the green part is 6.6g/cm$^3$. After pressing, the green part is put into a vacuum furnace. In the vacuum furnace, the lubricant and the binder are removed via the debinding process, and then the green part is sintered for 1.5 hours at a stable temperature of 1260° C. to form a workpiece of T15 tool steel. The density of the workpiece is 8.15 g/cm$^3$, the relative density is 99%, and the hardness is 485HV.

Eighth Embodiment

The difference between the eighth embodiment and the first embodiment is that, in the eighth embodiment, the mean particle size of the spray-dried powder 10 is 53 μm, which is smaller than the mean particle size (55 μm) of the spray-dried powder 10 of the first embodiment. Furthermore, in the eighth embodiment, the spray-dried powder 10 is heated to 120° C. The flowability of the spray-dried powder 10 at 120° C. is the same as the flowability of the spray-dried powder 10 at room temperature, such that the spray-dried powder 10 can still be filled into the mold cavity at 120° C., and such that a green part can be formed warmly according to the traditional dry pressing method. In the eighth embodiment, the density of the green part is 6.55 g/cm$^3$, the sintered density of the workpiece is 7.65 g/cm$^3$, the relative density is 98%, the shrinkage of the workpiece is 5.4%, and the hardness is 320 HV. The density, the relative density, and the hardness of the workpiece produced with the heating treatment of the eighth embodiment are higher than the density, the relative density, and the hardness of the workpiece of the first embodiment.

Please refer to FIG. 3 regarding the method of producing a workpiece according to the present invention; and FIG. 3 illustrates an experimental data table of producing a workpiece according to the present invention.

As shown in FIG. 3, the workpieces of the first comparison, the first embodiment, and the eighth embodiment are made of powders with the same composition by weight percent. The workpieces of the second comparison and the second embodiment are made of powders with the same composition by weight percent. The workpieces of the third comparison and the third embodiment are made of powders with the same composition by weight percent. The workpieces of the fourth comparison and the fourth embodiment are made of powders with the same composition by weight percent.

Via the method of the present invention, the densities, the relative densities, and the hardnesses of the workpieces of the first embodiment, the second embodiment, the third embodiment, the fourth embodiment, and the eighth embodiment are higher than those of the workpieces of the corresponding comparisons. Furthermore, referring to the first embodiment and the eighth embodiment, the density, the relative density, and the hardness of the workpiece produced with warm compaction of the eighth embodiment are higher than the density, the relative density, and the hardness of the workpiece of the first embodiment. From comparison of the workpieces of the second embodiment to the seventh embodiment, it is to be known that the method of the present invention can be applied to produce workpieces of stainless steel, high-speed steel, or tool steel, and such workpieces have high density, relative density, and hardness.

From the abovementioned comparisons and embodiments, it is to be known that via the method of the present invention, the press-and-sinter method of traditional powder metallurgy can be applied to form workpieces of stainless steel, high-speed steel, or tool steel, and such workpieces have high density, high hardness, and high dimensional stability.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A method of producing a workpiece, comprising:

providing a first powder, with a hardness of the first powder being less than 100 HV, with a carbon content of the first powder being less than 0.07 wt %, and with a mean particle size of the first powder being less than 20 μm, and wherein the first powder is a carbonyl iron powder;

mixing the first powder and a second powder to form a mixed powder, wherein mixing includes adding chromium, vanadium, manganese, and silicon in the form of prealloyed powders, and wherein in the mixed powder, a weight percent of the carbonyl iron powder is the largest proportion, a weight percent of carbon is less than 0.07 wt % or higher than 0.95 wt %, a weight percent of the chromium is between 3.5 and 18 wt %, a weight percent of molybdenum is less than 6 wt %, a weight percent of nickel is less than 5 wt %, a weight percent of copper is less than 5 wt %, a weight percent of niobium is less than 4 wt %, a weight percent of the vanadium is less than 5.5 wt %, a weight percent of cobalt is less than 5.5 wt %, a weight percent of tungsten is less than 13 wt %, a weight percent of the silicon is between 0.1 and 1 wt %, and a weight percent of the manganese is between 0.1 and 1 wt %;

adding a binder and water to the mixed powder, wherein a weight percent of the binder is no more than 1.2 wt %;

applying a spray drying process to granulate the mixed powder to form a spray-dried powder;

adding a lubricant to the spray-dried powder, wherein the total amount of the lubricant and the binder is no more than 1.3 wt %;

applying a dry pressing process to the spray-dried powder with the added lubricant to form a green part;

applying a debinding process to the green part to remove the binder and the lubricant and to form a debound body; and sintering the debound body into a workpiece, with the workpiece without any further post-sintering heat treatment having a hardness higher than 250 HV and a sintered density higher than 7.4 g/cm$^3$.

2. The method of producing a workpiece as claimed in claim 1, wherein sintering comprises sintering the debound body in a vacuum or a hydrogen-containing environment.

3. The method of producing a workpiece as claimed in claim 1, wherein a temperature of the dry pressing process is less than 160° C.

4. The method of producing a workpiece as claimed in claim 1, wherein a density of the green part is higher than 6.3 g/cm$^3$.

5. The method of producing a workpiece as claimed in claim 1, wherein the weight percent of carbon of the mixed powder is less than 0.07 wt %, and wherein the weight percent of chromium is between 15 to 18 wt %.

6. A workpiece, made according to the method of producing a workpiece as claimed in claim 1.

7. A method of producing a workpiece, comprising:

providing a first powder, with a hardness of the first powder being less than 200 HV, with a carbon content of the first powder being than 0.07 wt %, and with a mean particle size of the first powder being less than 20 μm, and wherein the first powder is a chromium-containing ferrous pre-alloyed powder and with the chromium content between 12 and 18 wt %;

mixing the first powder and a second powder to form a mixed powder, wherein mixing includes adding chromium, vanadium, manganese, and silicon in the form of prealloyed powders, and wherein in the mixed powder, a weight percent of the chromium-containing ferrous pre-alloyed powder is the largest proportion, a weight percent of carbon is less than 0.07 wt % or higher than 0.95 wt %, a weight percent of the chromium is between 11.7 and 18 wt %, a weight percent of molybdenum is less than 6 wt %, a weight percent of nickel is less than 5 wt%, a weight percent of copper is less than 5 wt %, a weight percent of niobium is less than 4 wt %, a weight percent of the vanadium is less than 5.5 wt %, a weight percent of cobalt is less than 5.5 wt %, a weight percent of tungsten is less than 13 wt %, a weight percent of the silicon is between 0.1 and 1 wt %, and a weight percent of the manganese is between 0.1 and 1 wt %;

adding a binder and water to the mixed powder, wherein a weight percent of the binder is no more than 1.2 wt %;

applying a spray drying process to granulate the mixed powder to form a spray-dried powder;

adding a lubricant to the spray-dried powder, wherein the total amount of the lubricant and the binder is no more than 1.3 wt %;

applying a dry pressing process to the spray-dried powder with the added lubricant to form a green part;

applying a debinding process to the green part to remove the binder and the lubricant to form a debound body; and sintering the debound body into a workpiece, with the workpiece without any further post-sintering heat treatment having a hardness higher than 250 HV and a sintered density higher than 7.4 g/cm$^3$.

8. The method of producing a workpiece as claimed in claim 7, wherein sintering comprises sintering the debound body in a vacuum or a hydrogen-containing environment.

9. The method of producing a workpiece as claimed in claim 7, wherein a temperature of the dry pressing process is less than 160° C.

10. The method of producing a workpiece as claimed in claim 7, wherein a density of the green part is higher than 6.3 g/cm$^3$.

11. The method of producing a workpiece as claimed in claim 7, wherein the carbon content of the chromium-containing ferrous pre-alloyed powder is less than 0.05 wt %.

12. The method of producing a workpiece as claimed in claim 7, wherein the weight percent of carbon of the mixed powder is less than 0.07 wt %, and wherein the weight percent of chromium is between 15 to 18 wt %.

13. A workpiece, made according to the method of producing a workpiece as claimed in claim 7.

* * * * *